US005117917A

United States Patent [19]

Robin et al.

[11] Patent Number: 5,117,917

[45] Date of Patent: Jun. 2, 1992

[54] FIRE EXTINGUISHING METHODS UTILIZING PERFLUOROCARBONS

[75] Inventors: Mark L. Robin; Yuichi Iikubo, both of W. Lafayette, Ind.

[73] Assignee: Great Lakes Chemical Corp., West Lafayette, Ind.

[21] Appl. No.: 557,949

[22] Filed: Jul. 26, 1990

[51] Int. Cl.[5] ..... A62D 1/00

[52] U.S. Cl. ..... 169/46; 169/44; 252/2

[58] Field of Search ..... 169/44, 46, 47, 43; 252/2, 8

[56] References Cited

U.S. PATENT DOCUMENTS 3,715,438 2/1973 Huggett ..... 514/771

3,844,354 10/1974 Larsen ..... 169/46

4,807,706 2/1989 Lambertsen et al. ..... 169/46 X

OTHER PUBLICATIONS

*Halogenated Fire Suppressants*, C. L. Ford., R. G. Gann, ed., ACS Symposium Series 16.

*Bull. Soc. Chim. Belg.*, 97, da Cruz, 1011 (1988).

*Primary Examiner*—Margaret A. Focarino

*Assistant Examiner*—James M. Kannofsky

*Attorney, Agent, or Firm*—Woodard, Emhardt, Naughton, Moriarty & McNett

[57] ABSTRACT

Completely fluorinated, saturated $C_2$, $C_3$ and $C_4$ compounds are efficient, non-ozone-depleting fire extinguishing agents used alone or in blends with other compounds in total flooding and portable systems.

2 Claims, No Drawings

FIRE EXTINGUISHING METHODS UTILIZING PERFLUOROCARBONS

BACKGROUND OF THE INVENTION

1. Field of the Invention

This invention relates to fire extinguishing methods utilizing the completely fluorinated $C_2$, $C_3$ and $C_4$ saturated molecules, $C_2F_6$, $C_3F_8$ and $C_4F_{10}$.

2. Description of the Prior Art

The use of certain bromine, chlorine and iodine-containing halogenated chemical agents for the extinguishment of fires is common. These agents are in general thought to be effective due to their interference with the normal chain reactions responsible for flame propagation. It is taught in the art that the effectiveness of the halogens is in the order Br>Cl>F, for example, C. L. Ford, in *Halogenated Fire Suppressants*, R. G. Gann, ed., ACS Symposium Series 16. This order of effectiveness is also taught in da Cruz, *Bull. Soc. Chim. Belg.*, 97, 1011 (1988), which reports the inhibiting properties of a series of methanes is in the order $CF_3Br > CFCl_3 > CF_2Cl_2 > CF_3Cl > CF_3H > CF_4$. It is taught that compounds containing the halogens Cl, Br and I act by interferring with free radical or ionic species in the flame and that the effectiveness of these halogens is in the order I>Br>Cl>F.

In contrast, perfluorocarbons (i.e., compounds containing only C and F atoms), have not heretofore been employed for the extinguishment of fires, since they have been regarded as not displaying any chemical action in the suppression of combustion. Thus, it is generally taught that to be effective as a fire extinguishing agent, a compound must contain Cl, Br or I.

The use of iodine-containing compounds as fire extinguishing agents has been avoided primarily due to the expense of their manufacture or due to toxicity considerations. The three fire extinguishing agents presently in common use are all bromine-containing compounds, bromotrifluoromethane ($CF_3Br$), bromochlorodifluoromethane ($CF_2BrCl$), and dibromotetrafluoroethane ($BrCF_2CF_2Br$). Although not employed commercially, certain chlorine-containing compounds are also know to be effective extinguishing agents, for example chloropentafluoroethane ($CF_3CF_2Cl$) as described in U.S. Pat. No. 3,844,354 to Larsen.

Although the above named bromine or chlorine-containing agents are effective in extinguishing fires, agents containing bromine or chlorine are asserted by some to be capable of the destruction of the earth's protective ozone layer.

It is therefore an object of this invention to provide a method for extinguishing fires that extinguishes fires as rapidly and effectively as the presently employed agents, and is environmentally safe with respect to ozone depletion.

SUMMARY OF THE INVENTION

The foregoing and other objects, advantages and features of the present invention may be achieved employing perfluorinated compounds and blends thereof with other compounds as fire extinguishants for use in fire extinguishing methods and apparatus. More particularly, the method of this invention involves introducing to a fire a saturated $C_2$, $C_3$ or $C_4$ completely fluorinated compound in a fire extinguishing concentration and maintaining such concentration until the fire is extinguished. Saturated perfluorocarbons of this invention include compounds of the formula $C_xF_{2x-2}$, where x=2 to 4. Specific perfluorocarbons useful in accordance with this invention include hexafluoroethane ($C_2F_6$), octafluoropropane ($C_3F_8$) and decafluorobutane ($C_4F_{10}$). These perfluorocarbons may be used alone or in admixture with each other or as blends with other fire extinguishing agents, optionally in the presence of an inert propellant. Generally the agents are employed in the range of about 2 to 15%, preferably 4 to 10%, on a v/v basis.

DESCRIPTION OF THE PREFERRED EMBODIMENTS

In accordance with the present invention, saturated $C_2$ through $C_4$ perfluorocarbons have been found to be effective fire extinguishing agents at concentrations safe for use. However, because such compounds contain no Br or Cl, they have an ozone depletion of zero, and hence present no threat to the earth's protective ozone layer.

Specific perfluorocarbons useful in accordance with this invention are compounds of the formula $C_xF_{2x+2}$, where x=2 to 4. Specific perfluorocarbons useful in accordance with this invention include hexafluoroethane ($C_2F_6$), octafluoropropane ($C_3F_8$), and decafluorobutane ($C_4F_{10}$).

The compounds may be used alone or in admixture with each other or in blends with other materials, optionally in the presence of a propellant. Among the other materials with which the perfluorocarbons of this invention may be blended are chlorine and/or bromine containing compounds such as $CF_3Br$, $CF_2BrCl$, $CF_3CF_2Cl$, and $BrCF_2CF_2Br$. Other compounds forming useful blends with the materials of the present invention include $CF_2HBr$, $CF_3CHFBr$, $CF_3CF_2H$, $CF_3CHFCF_3$, $CF_3CHFCl$, $CF_3CHCl_2$, and similar bromo or chlorofluorocarbons. The materials of this invention may also be used in the presence of a propellant, such as $CF_4$, $CF_3H$, $N_2$, $CO_2$ or Ar.

Where the perfluorocarbons of this invention are employed in blends, they are desirably at a level of at least about 5 percent by weight of the blend. The perfluorocarbons are preferably employed at high enough levels in such blends so as to minimize the adverse environmental effects of chlorine and bromine containing agents.

The perfluorocarbons of this invention are non-toxic, and may be effectively employed at substantially any minimum concentration at which the fire may be extinguished, the exact minimum level being dependent on the particular combustible material, the particular perfluorocarbon and the combustion conditions. In general, best results are achieved where the perflurocarbons or mixtures and blends are employed at a level of about 4% (v/v). Likewise the maximum amount to be employed will be governed by matters of economics and potential toxicity to living things. About 15% provides a convenient maximum for use of perfluorocarbons and their mixtures thereof in occupied areas. Concentrations above 15% may be employed in non-occupied areas, with the exact level determined by the particular combustible material, the perfluorocarbon or blend thereof employed, and the condition of combustion.

The perfluorocarbons may be applied using conventional application techniques and methods used for agents such as $CF_3Br$ and $CF_2BrCl$. Thus, the agents may be used in total flooding systems, portable systems or specialized systems. Thus, as is known to those skilled in the art, the perfluorocarbon may be pressurized with nitrogen or other inert gas at up to about 600 psig at ambient conditions.

Practice of the present invention is illustrated by the following examples, which are presented for purposes of illustration but not of limitation.

EXAMPLE 1

Concentrations of agent required to extinguish diffusion flames of n-heptane were determined using the cup burner method. Agent vapor was mixed with air and introduced to the flame, with the agent concentration being slowly increased until the flow was just sufficient to cause extinction of the flame. The data are reported in Table 1 , which demonstrate the effectiveness of the agents of this invention. Values for $CF_3Br$ and $CF_2BrCl$ are included for reference purposes.

TABLE 1

| Extinguishment of n-heptane Diffusion Flames | | | | |
|---|---|---|---|---|
| | Air flow | Agent Required | Extinguishing Conc. | |
| Agent | cc/min | cc/min | % v/v | mg/L |
| $CF_3CF_3$ | 16.200 | 1345 | 7.7 | 434 |
| $C_3F_8$ | 16.200 | 1006 | 5.8 | 445 |
| n-$C_4F_{10}$ | 16.200 | 697 | 4.1 | 398 |
| $CF_2BRCl$ | 16.200 | 546 | 3.3 | 222 |
| $CF_3Br$ | 16.200 | 510 | 3.1 | 189 |

EXAMPLE 2

The procedure of example 1 was repeated employing n-butane as fuel. Results are shown in Table 2, and demonstrate the efficacy of the agents of this invention for extinguishment of fires.

TABLE 2

| Extinguishment of n-Butane Diffusion Flames | | | | |
|---|---|---|---|---|
| | Air flow | Agent Required | Extinguishing Conc. | |
| Agent | cc/min | cc/min | % v/v | mg/L |
| $C_2F_6$ | 14.500 | 1067 | 6.9 | 389 |
| $C_3F_8$ | 16.200 | 859 | 5.0 | 384 |
| $CF_2BrCl$ | 16.200 | 420 | 2.5 | 168 |
| $CF_3Br$ | 16.200 | 396 | 2.4 | 146 |

EXAMPLE 3

A 28.3 liter test enclosure was constructed for static flame extinguishment tests (total flooding). The enclosure was equipped with a Plexiglas viewport and an inlet at the top for the agent to be tested and an inlet near the bottom to admit air. To test the agent, a 90×50 mm glass dish was placed in the center of the enclosure and filled with 10 grams of n-heptane. The fuel was ignited and allowed a 15 second preburn before introduction of the agent. During the preburn, air was admitted to the enclosure through the lower inlet. After 15 seconds, the air inlet was closed and the fire extinguishing agent was admitted to the enclosure. A predetermined amount of agent was delivered sufficient to provide 4.9% v/v concentration of the agent. The extinguishment time was measured as the time between admitting the agent and extinguishment of the flame. Average extinguishment times for a 4.9% v/v concentration are shown in Table 3.

TABLE 3

| Extinguishment Time (s), for 4.9% v/v Agent | |
|---|---|
| Agent | Extinguishing time, s |
| $C_3F_8$ | 2.4 |
| $CF_2BrCl$ | 1.8 |

Table 3 shows the extinguishment time required for $C_3F_8$ and $CF_2BrCl$ for n-heptane fuel at 4.9% v/v of agent. At this level $C_3F_8$ is as effective as $CF_2BrCl$ in extinguishing the flame, yet since it has an ozone depletion potential of zero, $C_3F_8$ presents no threat to the ozone layer.

While the bomine or chlorine containing agents $CF_3Br$ and $CF_2BrCl$ are somewhat more effective than the agents of this invention, the use of the agents in accordance with this invention remains highly effective and their use avoids the significant environmental handicaps encountered with chlorine and bromine containing agents.

We claim:

1. A method of extinguishing a fire comprising the steps of introducing to the fire a fire extinguishing concentration of a fire extinguishant composition comprising $C_4F_{10}$ and maintaining the concentration of the composition until the fire is extinguished.

2. A method for extinguishing a fire comprising the steps of:

introducing to the air surrounding the fire a fire extinguishing concentration of a mixture comprising:

a fire extinguishant composition comprising $C_4F_{10}$, and one or more compounds selected from the group consisting of $CF_3Br$, $CF_2BrCl$, $BrCF_2CF_2Br$, $CF_3CHFBr$, $CF_3CHCl_2$, $CF_3CHFCl$, $CF_3CF_2Cl$, $CF_3CF_2H$, $CF_3CHFCF_3$, $CF_2HCl$, $CF_3H$ and $CF_4$, wherein said fire extinguishant composition is present at a level of at least 1% by weight of the mixture; and maintaining the concentration of the mixture until the fire is extinguished.

* * * * *

UNITED STATES PATENT AND TRADEMARK OFFICE

CERTIFICATE OF CORRECTION

PATENT NO. : 5,117,917

DATED : June 2, 1992

INVENTOR(S) : Mark L. Robin, Yuichi Iikubo

It is certified that error appears in the above-identified patent and that said Letters Patent is hereby corrected as shown below:

In Column 1, line 44 change "know" to --known--.

In Column 4, line 25 change "bomine" to --bromine--.

Signed and Sealed this

Thirty-first Day of August, 1993

Bruce Lehman

*Attest:*

BRUCE LEHMAN

*Attesting Officer*

*Commissioner of Patents and Trademarks*